US010246931B2

(12) United States Patent
McKenna et al.

(10) Patent No.: US 10,246,931 B2
(45) Date of Patent: Apr. 2, 2019

(54) SLIDING WINDOW ARRANGEMENT

(71) Applicant: Aneeta Window Systems (VIC) Pty Ltd, Mitchum (AU)

(72) Inventors: Richard McKenna, Abbotsford (AU); Lars Nielsen, Camberwell (AU)

(73) Assignee: JELD-WEN, Inc., Charlotte, NC (US)

( * ) Notice: Subject to any disclaimer, the term of this patent is extended or adjusted under 35 U.S.C. 154(b) by 0 days.

(21) Appl. No.: 15/192,953

(22) Filed: Jun. 24, 2016

(65) Prior Publication Data

US 2017/0130512 A1 May 11, 2017

(30) Foreign Application Priority Data

Jun. 26, 2015 (AU) ..... 2015902492

(51) Int. Cl.

| | |
|---|---|
| ***E05F 17/00*** | (2006.01) |
| ***E05D 13/00*** | (2006.01) |
| ***E06B 3/44*** | (2006.01) |
| ***E05D 15/18*** | (2006.01) |

(52) U.S. Cl.

CPC ..... *E05F 17/002* (2013.01); *E05D 13/14* (2013.01); *E05D 15/18* (2013.01); *E06B 3/4415* (2013.01); *E05Y 2201/668* (2013.01); *E05Y 2900/148* (2013.01)

(58) Field of Classification Search

CPC ..... E05F 17/002; E05D 13/14; E06B 3/4415
See application file for complete search history.

(56) References Cited

U.S. PATENT DOCUMENTS

| | | | | |
|---|---|---|---|---|
| 1,439,373 A | | 12/1922 | Maier et al. | |
| 1,462,645 A | * | 7/1923 | Lancaster | E05D 13/14 160/190 |
| 1,462,647 A | * | 7/1923 | Lancaster | E05D 13/14 49/99 |
| 1,771,222 A | | 7/1930 | Kato | |
| 1,922,775 A | * | 8/1933 | Munkert | E05D 13/14 49/128 |
| 2,260,013 A | * | 10/1941 | Elvers | E05D 13/14 16/196 |

(Continued)

FOREIGN PATENT DOCUMENTS

| | | |
|---|---|---|
| AU | 199939136 B2 | 2/2000 |
| DE | 222568 C | 1/1908 |

OTHER PUBLICATIONS

Australian Patent Office, International-Type Search Report, dated Aug. 19, 2015.

*Primary Examiner* — Catherine A Kelly
(74) *Attorney, Agent, or Firm* — Stoel Rives LLP

(57) ABSTRACT

A sliding window assembly including a window frame and at least three panes disposed within the window frame in offset vertical planes. The panes are arranged for sliding movement together upwardly within the window frame or together downwardly within the window frame. One or more of the panes can be fixed. The panes have a fully open position and a fully closed position. In the closed position, respective edges of the panes overlap while in the open position, the entire panes overlap. The panes can be connected to a counterweight arrangement by a pulley arrangement, which includes a vertically movable balancing weight that is equal to the weight of the panes, or the panes can be connected together to counterbalance each other.

23 Claims, 9 Drawing Sheets

(56) References Cited

U.S. PATENT DOCUMENTS

| | | | | |
|---|---|---|---|---|
| 2,271,527 | A * | 2/1942 | Peck | E05D 13/14 16/194 |
| 2,315,970 | A * | 4/1943 | Krocker | E05D 13/14 16/196 |
| 6,311,757 | B1 * | 11/2001 | Schuette | E06B 9/0676 160/202 |
| 7,716,875 | B2 | 5/2010 | Langner | |
| 9,856,691 | B2 * | 1/2018 | Nielsen | E06B 3/44 |
| 2005/0055881 | A1 | 3/2005 | Gann | |
| 2014/0150346 | A1 | 6/2014 | Deboer | |
| 2016/0186484 | A1 * | 6/2016 | Nielsen | E06B 7/2305 49/458 |
| 2016/0222716 | A1 * | 8/2016 | Kim | E05D 13/00 |

* cited by examiner

SLIDING WINDOW ARRANGEMENT

TECHNICAL FIELD

The present disclosure relates to sliding windows, and particularly to windows that employ at least two sliding panes coupled together by a pulley arrangement for movement together in the same direction.

BACKGROUND

Sliding windows are available in various forms including forms in which the panes of a pair of panes are moveable relative to one another. A very common form of such a window includes a fixed pane and a movable or slidable pane, which is slidable vertically within the window. The slidable pane is connected to a counterbalancing weight by a suitable pulley or cord arrangement, so that upward or downward movement of the pane causes a corresponding downward or upward movement or the counterbalancing weight.

Other forms of sliding windows include two panes that are both moveable vertically within the window frame. In these forms of windows, both of the panes can include a counterbalancing weight of the above described kind so that they can be moved independently of each other, or alternatively, the panes can be connected to each other for movement with each other in opposite directions. In the latter form of window, the panes are connected to each other by a suitable pulley and cord arrangement, so that upward or downward movement of one pane causes a corresponding downward or upward movement of the other pane in the opposite direction.

Sliding windows of the above kind in which the panes are connected to each other can slide to a position of complete closure of a window opening and to an open position where they overlap in the middle of the window opening, exposing openings in the top and the bottom of the window opening. Alternatively, the panes can slide to a position where they are spaced apart to expose an opening centrally between them. Sliding panes of these kinds can also be used with fixed panes, such as upper and/or lower fixed panes, so that, for example, openings that would otherwise be formed at the top and/or bottom of a window opening can alternatively be positioned above and/or below the or each fixed pane. A relatively common arrangement is to have an upper fixed pane, or upper and lower fixed panes, and sliding panes below or between the upper or upper and fixed lower panes.

Sliding window arrangements of the above kind seek to maximise the useful opening that a window can provide while still allowing the window to be fully closed. The purchaser of a two-pane sliding window of the above described kind must therefore select prior to installation whether they want to have a window that provides a central opening between two spaced apart panes, or a window that provides top and bottom openings on either side. In either case, the window purchaser is generally looking to have the greatest possible opening formed within the window frame, along with the greatest possible simplicity in window operation and the least bulk (or most compact form).

The present applicant has therefore sought to develop a new and improved window assembly that provides one or more of the outcomes that a window purchaser looks for.

SUMMARY

In a first embodiment there is provided a sliding window assembly, including:

a window frame comprising a pair of spaced apart horizontal frame members and a pair of spaced apart vertical frame members, the frame members defining a square or rectangular window opening;

at least three panes disposed within the window frame comprising first and second sliding panes and a third fixed pane;

the panes being positioned within the frame in offset vertical planes;

the first and second panes being arranged for sliding movement together upwardly within the window frame or together downwardly within the window frame;

the panes having a fully open position and a fully closed position, whereby in the closed position, a first edge of the first pane is in overlap with an adjacent first edge of the second pane and a second edge of the second pane that is opposite to the first edge of the second pane is in overlap with an adjacent edge of the third pane;

in the open position, the first and second panes overlap with the third pane;

the first and second panes being connected to a counterweight arrangement by a pulley arrangement, the counterweight arrangement providing a vertically movable balancing weight which supports the weight of the first and second panes and which is movable vertically;

the first pane being connected to the balancing weight by a cord in connection with the first pane that extends upwardly about a first pulley and downwardly into fixed connection with the balancing weight; and the second pane being connected to the balancing weight by a cord arrangement that includes:

a first cord in connection with the second pane that extends upwardly about a second pulley and downwardly into fixed connection with a third pulley; and a second cord in fixed connection with the balancing weight that extends upwardly about the third pulley and downwardly to an anchor point.

The above embodiment advantageously permits each of the sliding panes to slide to a position in front of, behind or on either side of the fixed pane. This means that an opening which is equal to the area taken up by the two sliding panes in the closed position of those panes can be formed when the sliding panes are in the open position. Such an opening can be significantly greater than openings provided in prior art windows, where the sliding panes do not have the same extent of vertical sliding movement.

The window assembly of the first embodiment is also advantageous in that movement of both of the sliding panes can be initiated by a person moving only one of those panes. Thus, one of the sliding panes might include a finger grip, so that a person who wishes to open or close the window can grip the finger grip and lift the pane to which the finger grip is attached. By movement of the pane that has the finger grip attached, the second of the sliding panes will automatically move because of the connection through the pulley arrangement to the balancing weight. It is preferred that the sliding pane that needs the greatest amount of movement is the pane to which a finger grip is attached, as this would place the least stress on the pulley arrangement. Nevertheless, the finger grip could be applied to the sliding pane that requires least movement, whereby movement of that pane will result in the greater movement of the other sliding pane or panes.

The first and second panes can be of substantially the same perimeter dimensions and in accordance with the discussion above relating to the use of "substantially", the overlap between the first and second panes can be a complete overlap or a substantial overlap.

It is not essential that the sliding panes completely overlap with the fixed pane in the open position. The preference is that there is at least major or substantial overlap, whereby there is an allowance for a usually small portion of upper or lower edges of the panes (usually about 2' or less) to be in a non-overlapping position relative to one another in the open position. Thus, in the present specification, the expressions "overlap substantially", "substantially overlap" and like expressions are intended to cover arrangements whereby panes of the various embodiments as are described herein can have complete overlap or near complete overlap. It follows that in some embodiments, in the fully opened position, the substantial majority of the sliding panes overlap with the fixed pane, but the overlap is not complete overlap. The pair of sliding panes might each slide to the same position, whereby upper or lower edges of the panes extend above or below the adjacent edges of the fixed pane, or in alternative forms, the sliding panes can themselves be staggered relative to the fixed pane, so that the edge of a first of the sliding panes is slightly above or below the adjacent edge of the fixed pane, while the second of the sliding panes is a small amount above or below the edge of the first sliding pane. This can form a staggered arrangement which has aesthetic appeal and which allows a finger grip to be applied to either of the portion of the first or second of the panes that extends above or below the adjacent edge of the fixed pane.

It is to be noted that the inclusion of a finger grip is not an essential requirement for a window assembly according to the disclosure, but such a grip does assist opening and closing of the window.

In most embodiments, it is intended that the first and the second panes have the same perimeter dimensions and that the first pane is required to move approximately twice the distance of the second pane to reach the open position of the window assembly from the closed position. In most embodiments the third pane will also have approximately the same perimeter dimensions as the first and second panes, so that in the open position, the first and second panes can stack in front of, behind or on either side of the third pane with at least substantial overlap.

However, it is within the scope of the present disclosure that each of the first to third panes has a different perimeter dimension, or that two of the panes have the same perimeter dimension and the third is different.

Moreover, it is within the scope of the present disclosure that the movement of the first and second panes may be in a ratio which is other than 2:1 as described above, such as 3:1.

Moreover, it will be appreciated that while the first embodiment has been described as having three panes in total, the window assembly could equally have two fixed panes and two sliding panes, or one fixed pane and three or more sliding panes, or other combinations as required. To incorporate three sliding panes, the pulley arrangement would be modified to include a third pulley and a third cord.

The above discussion has proceeded on the basis that the window assembly includes a single balancing weight, but in most practical embodiments, there will be a pair of balancing weights which are positioned to slide adjacent to or at least partially within the pair of vertical frame members. Those vertical frame members are otherwise known as jambs and can be formed to have an outwardly opening channel form, so that the pulleys and the weights can be positioned within the channels and the weights can slide vertically within the channels. If only a single weight was provided, then that weight could be positioned adjacent to or at least partially within a single jamb, but for proper balancing of the sliding panes, balancing weights associated with each of the vertical frame members (and therefore on each side of the window frame) is preferred.

It follows that where balancing weights are associated with each of the vertical frame members, identical pulley and cord arrangements would be associated with each of the vertical frame members.

The present disclosure further provides in a second embodiment, a sliding window assembly, including:

a window frame comprising a pair of spaced apart horizontal frame members and a pair of spaced apart vertical frame members, the frame members defining a square or rectangular window opening;

at least three panes disposed within the window frame comprising first, second and third sliding panes;

the panes being positioned within the frame in offset vertical planes;

the first and second panes being arranged for sliding movement together upwardly within the window frame or together downwardly within the window frame;

the third pane being arranged for sliding movement in the opposite direction to the first and second panes upon sliding movement of the first and second panes;

the panes having a fully open position and a fully closed position, whereby in the closed position, a first edge of the first pane is in overlap with an adjacent first edge of the second pane, a second edge of the second pane that is opposite to the first edge of the second pane is in overlap with an adjacent first edge of the third pane;

in the open position, the first and second panes overlap;

the first and second panes being counterbalanced through connection to the third pane by a pulley arrangement, the pulley arrangement including first, second and third fixed upper pulleys and associated cords that extend about the first, second and third upper pulleys into connection with the first, second and third panes;

the first cord also extending into fixed connection with a first floating pulley that is positioned below the first, second and third upper pulleys and the second cord also extending about the floating pulley and upwardly to an anchor point;

the floating pulley being movable vertically upon vertical movement of the sliding panes and the floating pulley being connected to a fixed lower pulley by a cord that extends from the floating pulley downwardly about the fixed lower pulley and upwardly about the third upper pulley and into connection with the third pane.

The above second embodiment provides for sliding movement of all three panes but with the first and second panes always moving in the opposite direction to the third pane.

The above second embodiment can include a fourth fixed pane disposed within the window frame, the fourth pane being positioned within the frame in an offset vertical plane relative to the vertical plane of the first, second and third sliding panes. Thus, another embodiment provides a sliding window assembly including:

a window frame comprising a pair of spaced apart horizontal frame members and a pair of spaced apart vertical frame members, the frame members defining a square or rectangular window opening;

at least four panes disposed within the window frame comprising first, second and third sliding panes and a fourth fixed pane;

the panes being positioned within the frame in offset vertical planes;

the first and second panes being of substantially the same perimeter dimensions and being arranged for sliding movement together upwardly within the window frame or together downwardly within the window frame;

the third pane being arranged for sliding movement in the opposite direction to the first and second panes upon sliding movement of the first and second panes;

the panes having a fully open position and a fully closed position, whereby in the closed position, a first edge of the first pane is in overlap with an adjacent first edge of the second pane, a second edge of the second pane that is opposite to the first edge of the second pane is in overlap with an adjacent first edge of the third pane and, a first edge of the fourth pane is in overlap with an adjacent second edge of the third pane, that is opposite to the first edge of the third pane;

in the open position, the first, second and fourth panes overlap substantially with the third pane;

the first and second panes being counterbalanced through connection to the fourth pane by a pulley arrangement, the pulley arrangement including first, second and third fixed upper pulleys and associated cords that extend about the first, second and third upper pulleys into connection with the first, second and fourth panes;

the first cord also extending into fixed connection with a first floating pulley that is positioned below the first, second and third upper pulleys and the second cord also extending about the floating pulley and upwardly to an anchor point;

the floating pulley being movable vertically upon vertical movement of the sliding panes and the floating pulley being connected to a fixed lower pulley by a cord that extends from the floating pulley downwardly about the fixed lower pulley and upwardly about the third upper pulley and into connection with the fourth pane.

In this embodiment, two of the slidable panes can be either above or below the fixed pane and the other slidable pane can be on the other side of the fixed pane. In this arrangement, the first and second panes always move in the same direction, but with the first pane moving a greater distance than the second pane, while the third slidable pane moves in the opposite direction to the first and second panes.

As an example, in the above embodiment, the first and second panes could be located in a closed position of the window assembly in an upper part of the window frame and above the fixed pane. The third pane could be positioned below the fixed pane and each of the sliding panes could move to a position of overlap with the fixed pane in the open position of the window assembly. Of course the arrangement could be reversed whereby the first and second panes are positioned below the fixed pane and the third pane is positioned above the fixed pane.

While the above embodiment can include three sliding panes, another embodiment includes first and second upper sliding panes and third and fourth lower sliding panes, all of which slide to position of overlap with the fixed pane, which is a central pane. In this respect, such a window assembly includes at least five panes disposed within the window frame comprising first to fourth sliding panes and a fifth fixed pane, which are positioned within the frame in offset vertical planes. The first and second panes can be positioned above the fixed pane and can be arranged for sliding movement together upwardly or downwardly within the window frame and the third and fourth panes can be positioned below the fixed pane, also for sliding movement together upwardly or downwardly within the window frame, but in the opposite direction to the first and second panes. Each of the first to fourth panes can be of substantially the same perimeter dimensions.

In the closed position of the window assembly of one embodiment, a first edge of the first pane is in overlap with an adjacent first edge of the second pane, a second edge of the second pane that is opposite to the first edge of the second pane is in overlap with an adjacent first edge of the third or fixed pane, a first edge of the fourth pane is in overlap with an adjacent second edge of the third pane that is opposite to the first edge of the third pane and a second edge of the fourth pane that is opposite to the first edge of the fourth pane is in overlap with an adjacent first edge of the fifth pane. In the open position, the first, second, fourth and fifth panes overlap with the third pane.

The first and second panes are counterbalanced through connection to the fourth and fifth panes by the pulley arrangement. In some embodiments, this is achieved by the weight of the first and second panes being equal to the weight of the fourth and fifth panes. For this, the pulley arrangement can include first to fourth fixed upper pulleys and associated cords that extend about the first to fourth upper pulleys into connection with the first to fourth panes. The first cord extends about the first fixed upper pulley from the first pane and then extends about the first floating pulley and upwardly to a fixed anchor point. The second cord extends about the second fixed upper pulley from the second pane and then extends into fixed connection with a first floating pulley that is positioned below the first to fourth upper pulleys.

The first floating pulley is movable vertically upon vertical movement of the sliding panes and a cord that is fixed to the first floating pulley extends downwardly about a fixed lower pulley and then upwardly into fixed connection with a second floating pulley. The second floating pulley is movable vertically upon vertical movement of the sliding panes. Third and fourth cords extend from the second floating pulley.

In respect of the third cord, that cord extends from the third pane about a third fixed upper pulley and then downwardly into fixed connection with the second floating pulley.

In respect of the fourth cord, that cord extends from the fourth pane about a fourth fixed upper pulley and then downwardly about the second floating pulley. The fourth cord then extends upwardly from the second floating pulley to a fixed anchor point.

Where the first to fourth panes are of the same size and shape (and therefore have the same perimeter dimensions), movement of one of those panes will result in movement of the other three sliding panes vertically within the window frame. Also, the first and second floating pulleys will move vertically, but in opposite directions. Further, where the first pane is the upper most pane in the closed position of the panes, and where the fourth pane is the lower most pane, the first and fourth panes will move an equal distance from the closed to open positions, while the second and third panes will also move an equal distance, but approximately half of the distance of the first and fourth panes. In this arrangement, the fifth and fixed pane will be positioned centrally of the window opening and, in the open position of the panes, the first to fourth panes will be in overlap with the fixed pane. For this, the arrangement can be such that the first and second panes can overlap either in front of or behind the fixed pane, while the third and fourth panes can overlap on the opposite side of the fixed pane to the first and second panes.

It will be appreciated that in this embodiment, in which five panes are provided, the depth from front to back of the window assembly will be equal to the thickness of the five panes plus the spacing between them.

As with the first embodiment, it will be readily appreciated that a window assembly according to other embodiments could incorporate a greater number than five panes. For example, there could be six sliding panes or eight sliding panes, and there could be multiple fixed panes. There could also be odd numbers of sliding panes so that window assemblies incorporating five or seven panes could be provided. In all of these embodiments, the sliding panes are connected, so that movement of one of the sliding panes results in movement of all of the sliding panes. This allows a finger grip to be applied to just one of the sliding panes to move all of the sliding panes, although where a large number of sliding panes is provided, two or more finger grips might be provided to assist movement of the panes between open and closed positions.

As with the first embodiment, other embodiments envisages the vertical frame members to be formed with channels to accommodate edges of the panes and to accommodate the various components of the pulley arrangement so that all of those components are obscured from view and so that in a window assembly according to either the first or the second embodiments, only the frame members and the panes are visible.

In some embodiments, there is no balance weight that is accommodated within the vertical frame members but rather, the balance weight is effectively formed by the panes themselves. Thus, the balance weight for the first and second panes is provided either by the third pane, or by the third and fourth panes. In other embodiments where more than four slidable panes are provided, it remains the case that the slidable panes are balanced by other sliding panes that move in opposite directions. It is thus the case that in some embodiments, there will be one or more panes that move upwardly from the opened position to the closed position, and those panes will be balanced by one or more panes that move in the opposite direction between the open and closed positions. In each case, the oppositely moving panes will be connected through at least one floating pulley which is movable vertically and through cords that connect the panes to one another.

In the above embodiments, a fixed pane is provided. It will be readily appreciated however, that the movement of panes within a window frame could equally occur without a fixed pane being provided. Thus, for example, a third embodiment could be embodied in an arrangement that comprises at least three panes disposed within the window frame comprising first, second and third sliding panes. In this embodiment, the panes would be positioned within the frame in offset vertical planes and the first and second panes could have, but are not required to have substantially the same perimeter dimensions. The first and second panes would be arranged for sliding movement together upwardly within the window frame or together downwardly within the window frame.

The third pane would be arranged for sliding movement in the opposite direction to the first and second panes upon sliding movement of the first and second panes. Like the first and second embodiments, the three panes would have a fully open position and a fully closed position, whereby in the closed position, a first edge of the first pane is in overlap with an adjacent first edge of the second pane and a second edge of the second pane that is opposite to the first edge of the second pane is in overlap with an adjacent first edge of the third pane. In this embodiment, in the open position, the first and second panes overlap. The first and second panes can overlap with the third pane, if the panes are arranged to move towards each other in the open position. Alternatively, the first and second panes could move away from the third pane to assume the open position, so that the first and second panes overlap but are spaced from the third pane.

To facilitate movement of the panes in this third embodiment, the first and second panes can be counterbalanced through connection to the third pane by a pulley arrangement. The weight of third pane would be greater than the individual weight of the first and second panes to provide appropriate counterbalance. The actual weight can vary depending on the amount of movement required to be counterbalanced, but in one example, where the individual weight of the first and second panes is the same, and where the first pane moves twice the distance of the second pane, then the weight of the third pane can be 1.5 times the individual weight of the first pane for appropriate counterbalance.

The pulley arrangement can include first, second and third fixed upper pulleys and associated cords that extend about the first, second and third upper pulleys into connection with the first, second and third panes. The first cord can extend into fixed connection with a first floating pulley that is positioned below the first, second and third upper pulleys and the second cord can also extend about the floating pulley and upwardly to an anchor point. The floating pulley can be movable vertically upon vertical movement of the sliding panes and the floating pulley being connected to a fixed lower pulley by a cord that extends from the floating pulley downwardly about the fixed lower pulley and upwardly about the third upper pulley and into connection with the third pane.

While the third embodiment can be installed with three panes only, fixed panes can be included. Upper and lower fixed panes can be employed such that the first and second panes move to a position in overlap with the upper or lower fixed pane, and the third pane can move into overlap with the other of the fixed panes.

Alternatively, a single fixed pane can be employed such as an upper or lower fixed pane, or a fixed pane that is fixed intermediate upper or lower sections of the window frame.

Further, the third embodiment can be installed so that one or more of the three moveable panes can move through an opening or into a pocket or recess formed in a ceiling, floor or wall of a building in which the sliding window assembly is installed. Indeed, this applies to earlier forms as well where one or more moveable panes move to an upper or lower section of the window frame. For example, and with reference to the third embodiment, where the first and second panes move away from the third pane to assume the open position of the sliding window assembly, the third pane could slide or move through an opening or into a pocket or recess so that the pane is completely or substantially obscured from view. The height or depth of the pocket or recess would thus be equal to or greater than the vertical height of the third pane or in other words, the pocket or recess would have a depth along the direction of travel of the panes that is equal to or greater than the height of the pane that is to enter the pocket or recess. This applies equally to the height or depth of the pocket or recess into which any of the panes of any of the embodiments are to move into.

Movement of one or more of the panes through an opening or into a pocket or recess formed in the ceiling or floor can advantageously remove the pane or panes as an obstruction to movement of people or objects through the opening formed in the window assembly. Thus, movement of one or more of the panes through an opening or into a pocket or recess formed in the floor can mean that people can move past the pane without having to step over it. Likewise, movement of one or more of the panes through an opening or into a pocket or recess formed in the ceiling can mean that people can move past the pane without having to lower their heads for example.

In the third embodiment, three movable panes are provided, but in a further embodiment, only two movable panes are provided. In this fourth embodiment, the panes would be positioned within the frame in offset vertical planes and the first and second panes could have, but are not required to have substantially the same perimeter dimensions. The first and second panes would be arranged for sliding movement together upwardly within the window frame or together downwardly within the window frame. The two panes advantageously could move through an opening or into a pocket or recess formed in a ceiling, floor or wall of a building in which the sliding window assembly is installed. For example, the first and second panes could move through an opening or into a pocket or recess so that they are completely or substantially obscured from view, providing the same advantages discussed above in relation to the third embodiment.

In the fourth embodiment, the first and second panes would be connected to a counterweight arrangement by a pulley arrangement, the counterweight arrangement providing a vertically movable balancing weight which supports the weight of the first and second panes; the first pane being connected to the balancing weight by a cord in connection with the first pane that extends upwardly about a first pulley and downwardly into fixed connection with the balancing weight; and the second pane being connected to the balancing weight by a cord arrangement that includes: a first cord in connection with the second pane that extends upwardly about a second pulley and downwardly into fixed connection with a third pulley; and a second cord in fixed connection with the balancing weight that extends upwardly about the third pulley and downwardly to an anchor point.

It will be apparent that the embodiments can take a variety of forms embodiments in addition to the four embodiments discussed above can be provided.

BRIEF DESCRIPTION OF DRAWINGS

In order that the disclosure may be more fully understood, some embodiments will now be described with reference to the figures in which.

DETAILED DESCRIPTION

Figure 1:
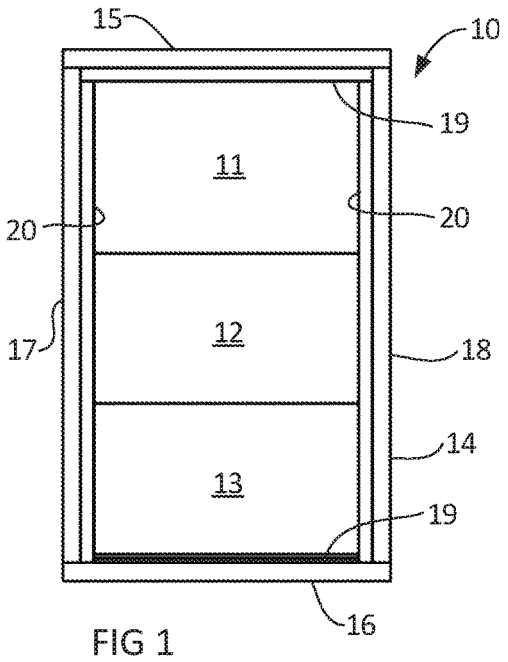
FIG. 1 is a front view of a window assembly according to a first embodiment.

FIG. 1 is a front view of a window assembly according to a first embodiment of the present disclosure. The window assembly 10 includes a first and fixed upper pane 11 and a pair of sliding panes 12 and 13. In FIG. 1, the sliding panes 12 and 13 are shown in a closed position, in which they are positioned at their vertically lower most positions within the frame 14 of the assembly 10.

The frame 14 comprises a pair of spaced apart horizontal frame members comprising a head 15 and a sill 16. The frame 10 further comprises a pair of spaced apart vertical frame members, comprising side jambs 17 and 18. Extending inwardly from each of the head 15, sill 16 and jambs 17 and 18, are channels 19 and 20. The channels accommodate the upper edge of the fixed pane 11, the side edges of both the pane 11 and the sliding panes 12 and 13, and the bottom edge of the pane 13 when that pane is in the closed position shown in FIG. 1.

Figure 2:
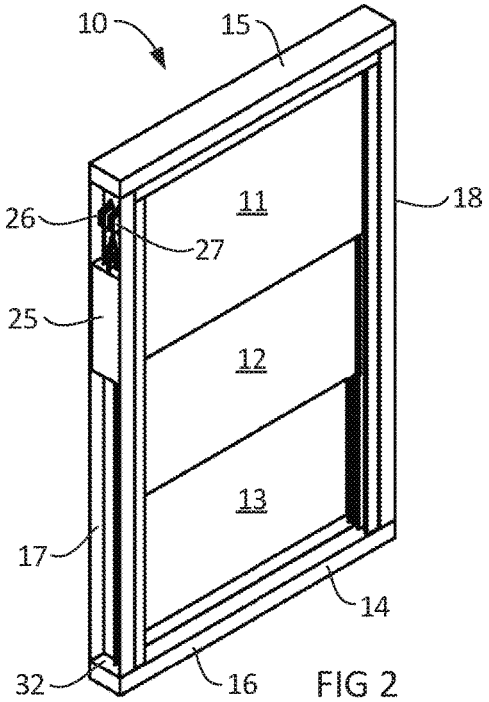
FIG. 2 is an isometric view of the window assembly of FIG. 1.
Figure 3:
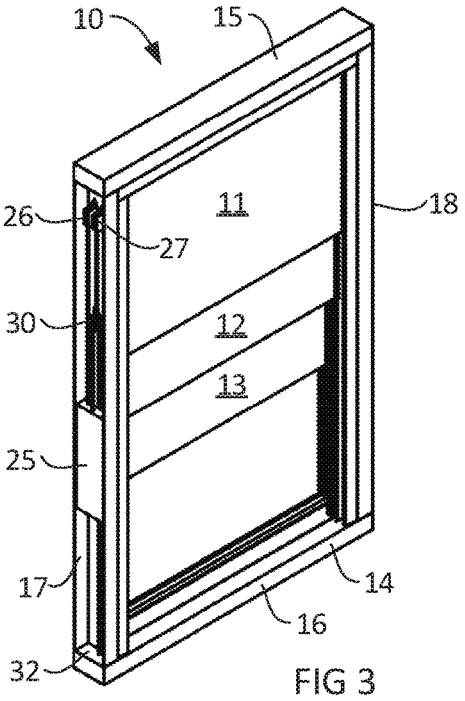
FIG. 3 is the same view as FIG. 2, except with the window panes shown in a partially open position.
Figure 4:
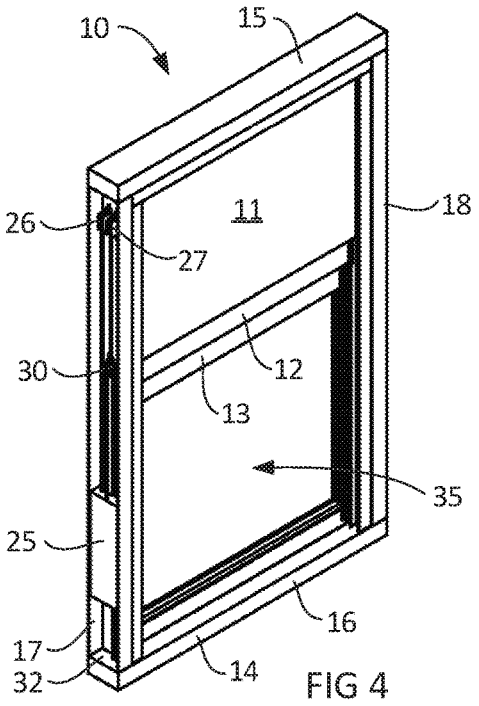
FIG. 4 is the same view as FIG. 2, except with the window panes shown in a substantially fully open position.

For sliding movement of the panes 12 and 13, a counterweight arrangement is provided which comprises weight 25 shown in each of the isometric views of FIGS. 2 to 4. The weight 25 is shown accommodated within the outwardly facing channel of the jamb 17, and it is to be understood that the same arrangement is provided in the jamb 18, but is obscured from view in FIGS. 2 to 4.

It is to be noted that the arrangements of FIGS. 1 to 4 require a single weight 25 in each of the jambs 17 and 18. That is, each of the sliding panes 12 and 13 is attached to the weight 25, so that a separate weight is not required to be attached in each of the jambs 17 and 18 for each of the panes 12 and 13. The weights 25 have a combined weight equal to the weight of 1.5 times the weight of a single pane. The panes 12 and 13 are of equal weight. This arrangement advantageously can reduce the cost of the window assembly 10 by requiring only a single weight in each of the jambs 17 and 18, and can assist to reduce the bulk of the assembly 10 over assemblies that include a weight for each of the panes 12 and 13.

The arrangement of the window assembly 10 is such that the sliding panes 12 and 13 move together as shown in the sequence from FIG. 2 to FIG. 4, by way of a geared pulley system that allows the pane 12 to move about half the distance of the pane 13. By this arrangement, the panes 12 and 13 can stack behind each other and behind the fixed pane 11 as shown in FIG. 4 to provide an opening in the window assembly 10 which is slightly less than the full height of the window below the fixed pane 11. It is to be noted that while FIG. 4 shows the panes 11, 12 and 13 in a slightly staggered arrangement, it is possible for the present disclosure to have the panes 12 and 13 stack completely one behind the other, so that the bottom ends or edges of the panes 12 and 13 are at the same position or height, and it is further possible for the present disclosure to have those panes stacked completely behind the fixed pane 11 so that there is no projection of sliding panes below the fixed pane 11 in the fully open condition of the window assembly.

It has been mentioned above that the panes 12 and 13 move together from the closed position of FIG. 2 to the open position of FIG. 4. It has further been mentioned that that movement comprises twice the amount of movement for sliding pane 13 compared to sliding pane 12. That differential in movement between panes 12 and 13 is achieved through a unique pulley arrangement that attaches to the panes 12 and 13 and to the weights 25 secured within the jambs 17 and 18 as will be discussed hereinafter.

Figure 5:
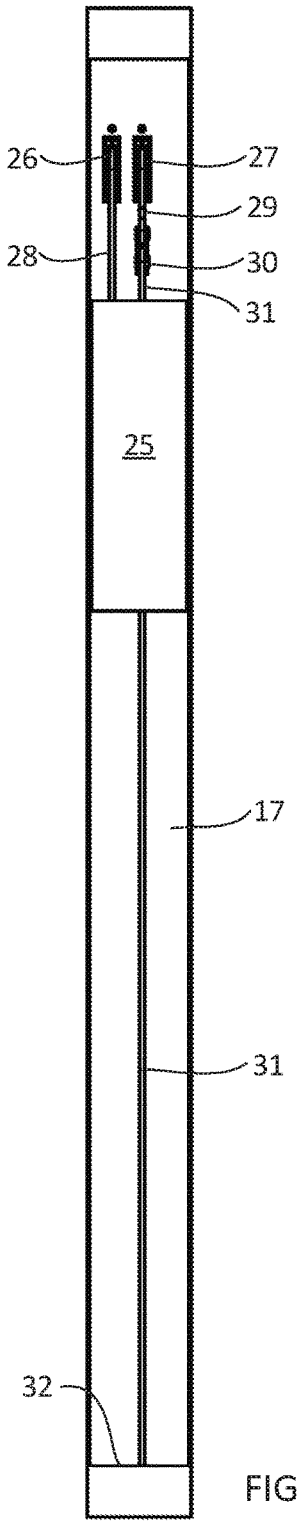
FIG. 5 is a side view of the window assembly of FIG. 1.

FIG. 5 is a side view of the window assembly 10 and shows the weight 25 in the upper position of FIG. 2. In that position, the panes 12 and 13 are in a closed position and are therefore only able to move upwardly.

FIG. 5 also illustrates a pulley arrangement which comprises a pair of pulleys 26 and 27. The pulleys 26 and 27 are mounted to the jamb 17, with an identical arrangement applied to the jamb 18, and cords 28 and 29 extend about the pulleys 26 and 27 and into connection with side edges of the respective panes 12 and 13. In this respect, the cord 28 and the pulley 26 are associated with the pane 13, while the cord 29 and the pulley 27 are associated with the pane 12.

The cord 28 extends into direct connection with the weight 25. Any suitable connection to the weight 25 can be made. Thus, the cord 28 extends from the weight 25, about the pulley 26 and into connection with a side edge of the pane 13. By this direct connection, the amount of movement of the pane 13 directly results in the same amount of movement of the weight 25, but in the opposite direction. That is, upward movement of the pane 13 an amount X will result in the same amount of movement of the weight 25, but downward.

In contrast, the cord 29 is connected to a further pulley 30. That connection between the cord 29 and the pulley 30 is a fixed connection. A further cord 31 has one end connected to the weight 25, and the other end connected to the bottom of the jamb 17 at the fixed anchor point 32. Thus, the cord 31 extends from the weight 25 about the pulley 30 and down to the anchor point 32.

The pulley 30 is thus a floating pulley, which moves upwardly and downwardly with the weight 25. It also moves upwardly and downwardly with the sliding pane 12, but provides a gearing for the pane 12 so that for whatever distance the weight 25 moves, the pane 12 moves half that distance. This allows the panes 12 and 13 to move as shown between FIGS. 2 and 4 whereby the pane 12 moves half the overall distance of the pane 13, and whereby the pane 13 moves the same distance as the weight 25, but in a different direction. In an alternative embodiment, the counterweight arrangement includes a balancing weight 25 in only one of the jambs 17 or 18, with the same pulley arrangement 26-31, in which case the single balancing weight 25 weighs 1.5 times the weight of a single pane (i.e., more than the weight of the pane 13 and less than the combined weight of both panes 12 and 13).

One advantage of the arrangement shown in FIGS. 1 to 5, is that a substantial opening 35 (see FIG. 4) is made in the window assembly 10, which is greater than the openings of the prior art windows described above. Moreover, it would be appreciated that where the window assembly 10 could include more than just the two sliding panes 12 and 13 which are illustrated and operate under the same basic concept, such that the third window could shift the distance of the weight 25, while the other two windows could shift smaller amounts based on the use of floating pulleys. Any number of sliding panes could be employed subject to the depth (from front to back) of the assembly 10 being acceptable. That is, because the sliding panes need to nest behind each other in the open position, the addition of further sliding panes will result in a greater depth of the window between the front and rear surfaces. The maximum depth allowed in any window assembly could thus dictate the number of sliding panes that can be employed.

Figure 6:
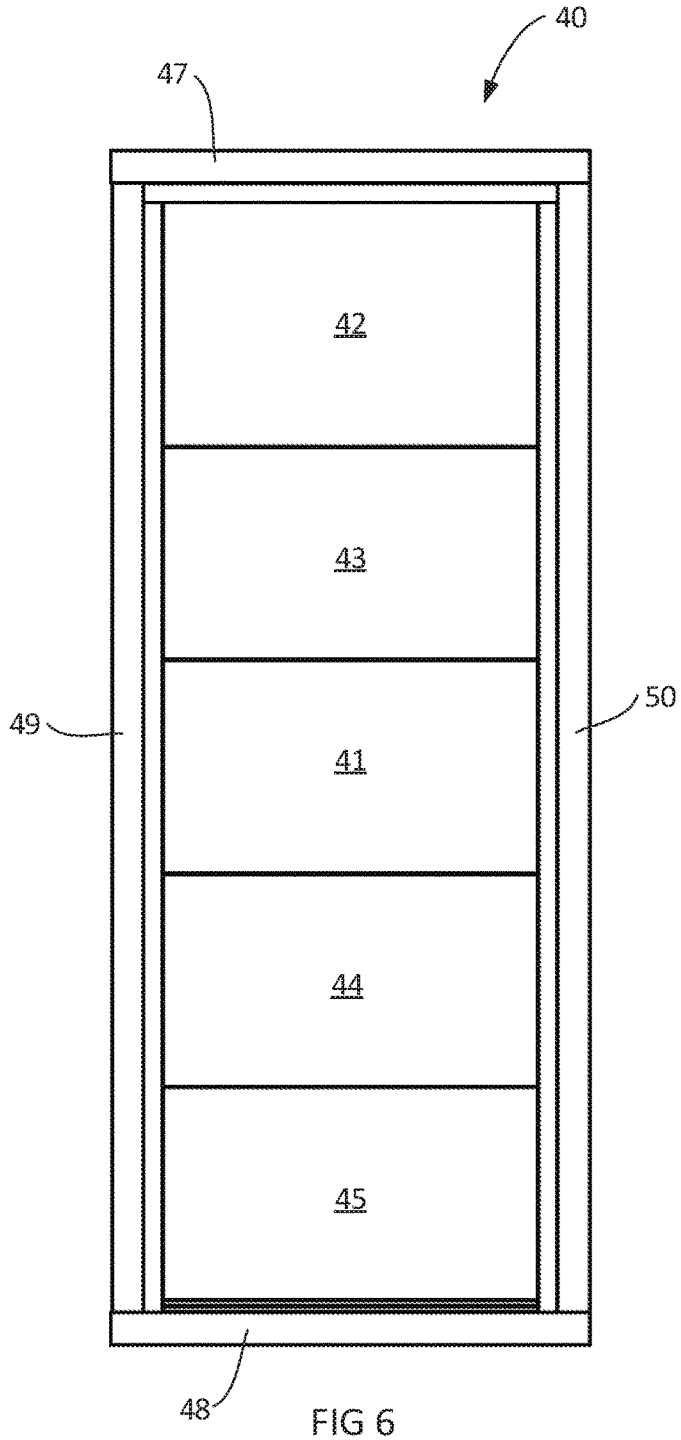
FIG. 6 is a front view of a window assembly according to a second embodiment.
Figure 9:
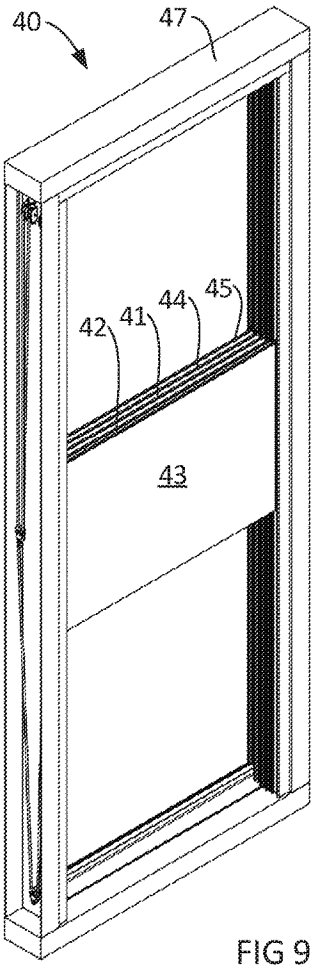
FIG. 9 is the same view as FIG. 7, except with the window panes shown in a substantially fully open position.
Figure 8:
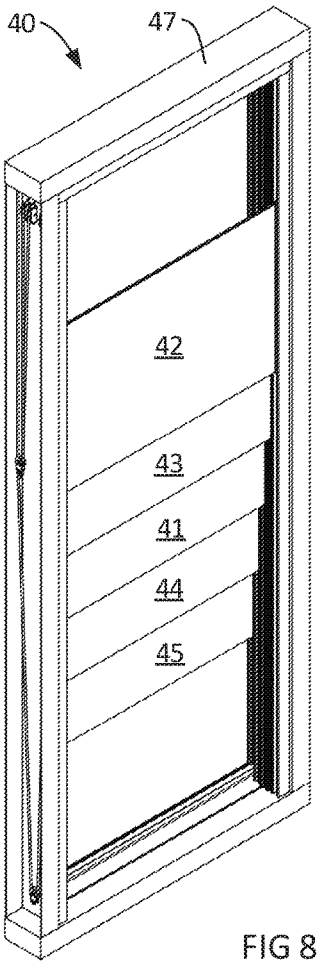
FIG. 8 is the same view as FIG. 7, except with the window panes shown in a partially open position.
Figure 7:
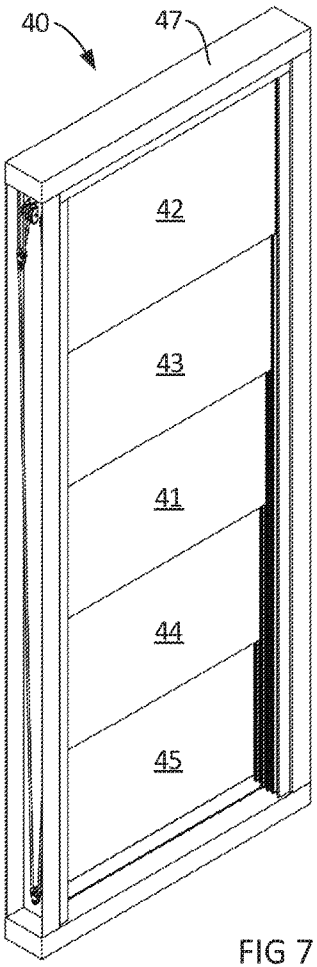
FIG. 7 is an isometric view of the window assembly of FIG. 6.
Figure 10:
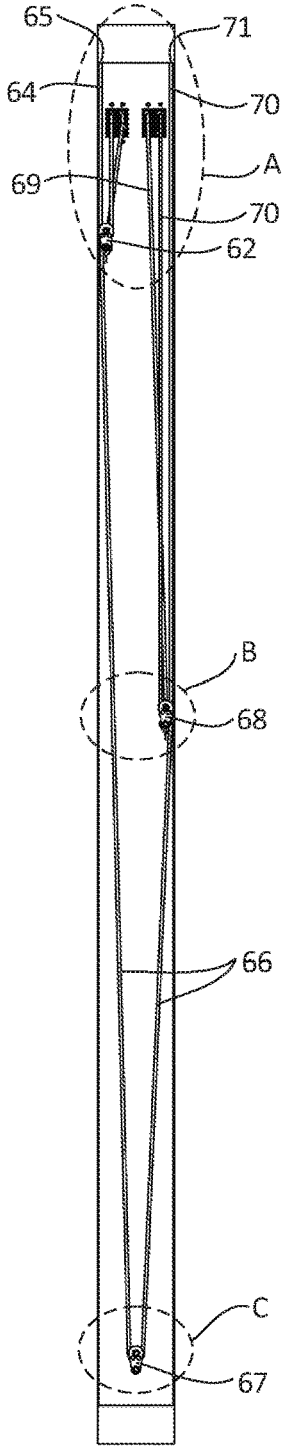
FIG. 10 is a side view of the window assembly of FIG. 6.

FIG. 6 illustrates a second embodiment of the present disclosure in which a window assembly 40 is illustrated as having a single central fixed pane 41 and pairs of upper and lower sliding panes. The upper sliding panes comprise panes 42 and 43, while the lower sliding panes comprise panes 44 and 45. As will be explained hereinafter, from the window closed position as shown in FIG. 6, panes 42 and 43 move downwardly into a position in front of fixed pane 41, while panes 44 and 45 move upwardly into a position behind pane 41. The sequence of movement is illustrated in FIGS. 7 to 9.

As with the window assembly 10, the window assembly 40 includes a frame 46 that comprises a head 47, a sill 48 and jambs 49 and 50. Side edges of the panes are accommodated in channels in the jambs 49 and 50, while upper and lower edges of the sliding panes 42 and 45 respectively are also accommodated within channels formed in the head 47 and sill 48 respectively when the panes are in the closed position of FIG. 6.

The window assembly 40 illustrates how a greater number of sliding panes can be employed in a sliding manner to achieve a significant window opening. FIG. 9 illustrates that the sliding panes 42 to 45 align either directly in front of or behind the fixed pane 41, so that openings substantially equivalent to the height of two panes are formed above and below the fixed pane 41. While further description will relate specifically to the form of window assembly 40, it should be appreciated that the position of the fixed pane 41 can vary, so that it could be at the very top of the frame 46 adjacent the head 47, or at the very bottom of the frame 46, adjacent the sill 48, or in between. Moreover, it will be appreciated that while the number of sliding panes has been shown as four, any number of sliding panes can be provided. For example, there could there be a single sliding pane above the fixed pane and a pair of sliding panes below the fixed pane, so that there is an odd number of sliding panes.

The window assembly 40 does not include a weight 25 of the kind employed in the window assembly 10, however, the window assembly 40 does include a counterweight arrangement which employs the weight of the sliding panes as balancing weights as explained below.

The counterweight arrangement of the window assembly 40 includes a pulley arrangement to connect the sliding panes to each other so that the sliding panes form a counterbalance for each other.

Figure 11:
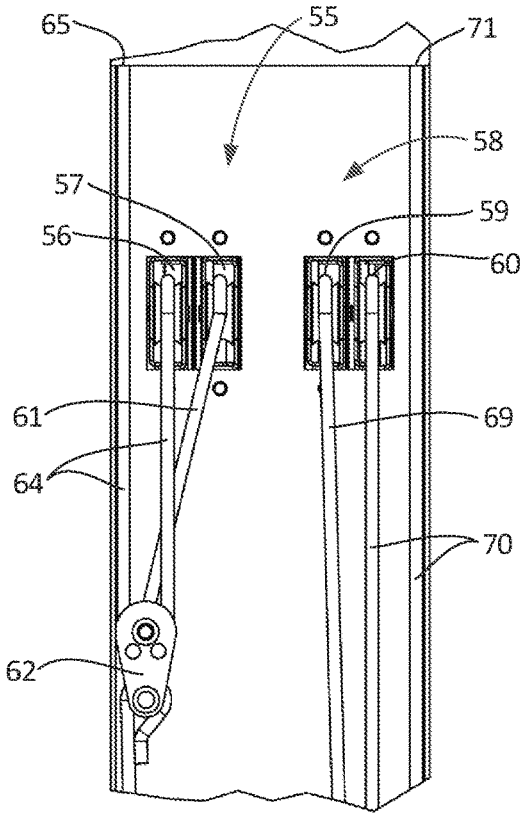
FIG. 11 is a detailed view of section A of FIG. 10.
Figure 12:
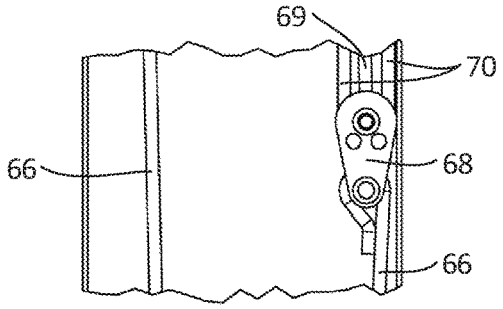
FIG. 12 is a detailed view of section B of FIG. 10.
Figure 13:
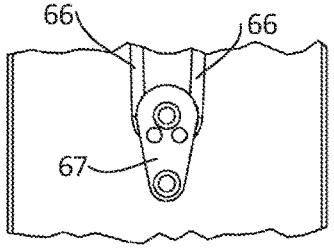
FIG. 13 is a detailed view of section C of FIG. 10.

The pulley arrangement of the window assembly 40 is illustrated in FIG. 10 and FIGS. 11 to 13, whereby FIGS. 11 to 13 are detailed views at items A, B and C respectively. With reference to those figures, the pulley arrangement comprises a first pair of pulleys 55 (see FIG. 11), comprising pulleys 56 and 57 and a second pair of pulleys 58 comprising pulleys 59 and 60. The first pair of pulleys 55 is associated with the sliding panes 44 and 45, while the second pair of pulleys 58 is associated with the sliding panes 42 and 43.

In respect of the first pair of pulleys 55, the pulley 56 is associated with the pane 45 and the pulley 57 is associated with the pane 44. In this respect, a cord 61 extends about the pulley 57 and into connection with a side edge of the pane 44. The opposite end of the cord 61 attaches to a floating pulley 62. That end is fixed to the pulley 62 so that movement of the pulley 62 either up or down results in the same direct amount of movement of the pane 44 up or down.

A further cord 64 extends about the pulley 56 and into connection with a side edge of the pane 45. The opposite end of the cord 64 extends into fixed connection at an upper end of the jamb 49 at fixed anchor point 65.

The pulley 62 is connected to a further cord 66, which is also shown in FIGS. 12 and 13, which extends to a fixed base pulley 67. That is, the base pulley 67 is fixed in position relative to the jamb 49 so that it cannot move up or down. The cord 66 extends about the base pulley 67 and upwardly into fixed engagement with a further floating pulley 68. That floating pulley 68 is attached to a cord 69 that extends about the pulley 59 and into engagement with a side edge of the pane 43. The arrangement of the cord 69 is similar to the cord 61, in that movement of the pulley 68 either up or down results in the same direct amount of movement of the pane 43 up or down.

A further cord 70 extends from a side edge of the pane 42, about the pulley 60 and down to the floating pulley 68. That cord extends about the floating pulley 68 and upwardly into fixed connection at the upper end of the jamb 50 at fixed anchor point 71.

The direct connection of the cord 69 to the pane 43 and the pulley 68 means that the distance the pulley 68 moves will be directly equal to the upward or down movement of the pane 43. In contrast, by the cord 70 extending about the pulley 68 and being anchored at either end firstly to a side edge of the pane 42 and secondly to the anchor point 71, movement of the pane 42 will be equal to twice the distance of movement of the pulley 68.

Figure 14:
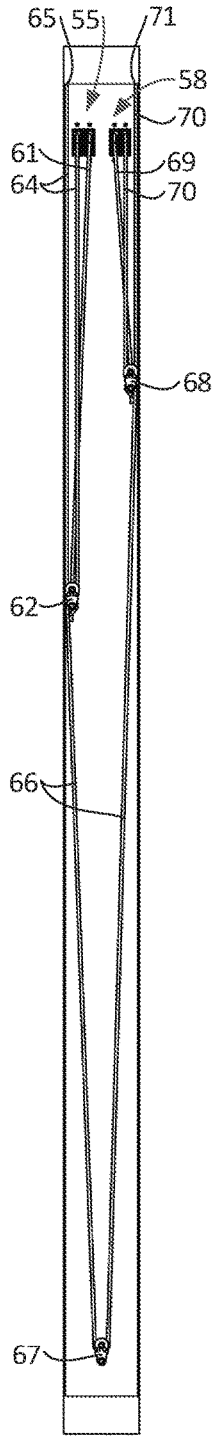
FIG. 14 is a side view showing the panes in the position of FIG. 8.
Figure 15:
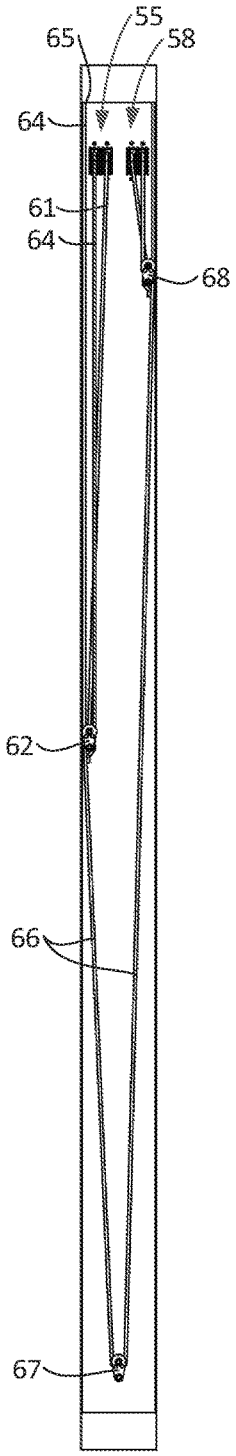
FIG. 15 is a side view showing the panes in the position of FIG. 9.
Figure 16:
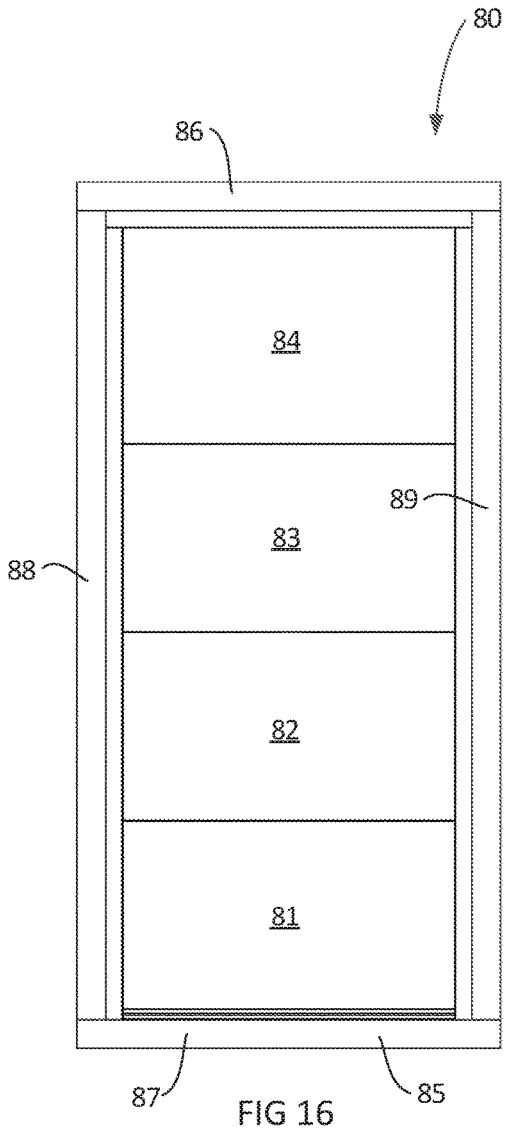
FIG. 16 is a front view of a window assembly according to a third embodiment.

Returning to FIGS. 6 to 9, the arrangement is such that with movement of the pane 42 downwards from the closed position of FIGS. 6 and 7, the floating pulley 68 will move upwardly the same distance that the pane 42 moves downwardly. Given that the floating pulley 68 is obscured in each of FIGS. 7 to 9, further end views equivalent to FIG. 10, but with the floating pulleys 62 and 68 shifted, are illustrated in FIGS. 14 and 15. With reference to FIG. 14, the floating pulley 68 has lifted to the same extent as the pane 42 has shifted downwardly between the positions of FIGS. 7 and 8.

FIG. 15 illustrates further travel of the floating pulley 68 upwardly for the floating panes 42 to 45 to reach the completely overlapping position shown in FIG. 9. As will be appreciated, the floating pulley 62 travels downwardly as the floating pulley 68 travels upwardly and the travel of the respective floating pulleys is equal in terms of vertical displacement.

It will be evident from the figures relating to the window assembly 40 that initiating a single movement with any one of the floating panes 44 to 45 will create an equivalent and proportional movement of the other panes. This makes it quite easy for the window to be opened and closed between the positions of FIGS. 7 and 9, while the window can also be locked simply by locking a single one of the panes 42 to 45. Moreover, by reducing the height of each of the panes, the central region of FIG. 9 where the panes are stacked together can be reduced, increasing the overall openings which are formed above and below the fixed pane 41. Also, as indicated earlier, arrangements could be employed whereby there are three moving panes above a fixed pane and three moving panes below the fixed pane, whereby the operation of the window would be as per shown in FIGS. 6 to 15, but with a further pulley in the pulley groups 55 and 58 and a further geared floating pulley to control the movement of the additional panes. In that sense, the additional panes would move one third of the distance of the maximum pane movement and the gearing would therefore be included to achieve that movement.

The window assemblies 10 and 40 show three pane and five pane assemblies each. In each case, one of the panes is fixed and the other panes are moveable.

FIGS. 16 to 24 show a still further version of a window assembly according to an embodiment, which includes a fixed bottom pane and three sliding panes which are positioned above the bottom pane. Thus, the window assembly 80 includes a bottom fixed pane 81 and sliding panes 82 to 84. The window assembly 80 is shown in a fully closed position in FIG. 16, and it will be appreciated that for the window assembly 80 to be fully opened, each of panes 82 to 84 move downwardly.

Figure 19:
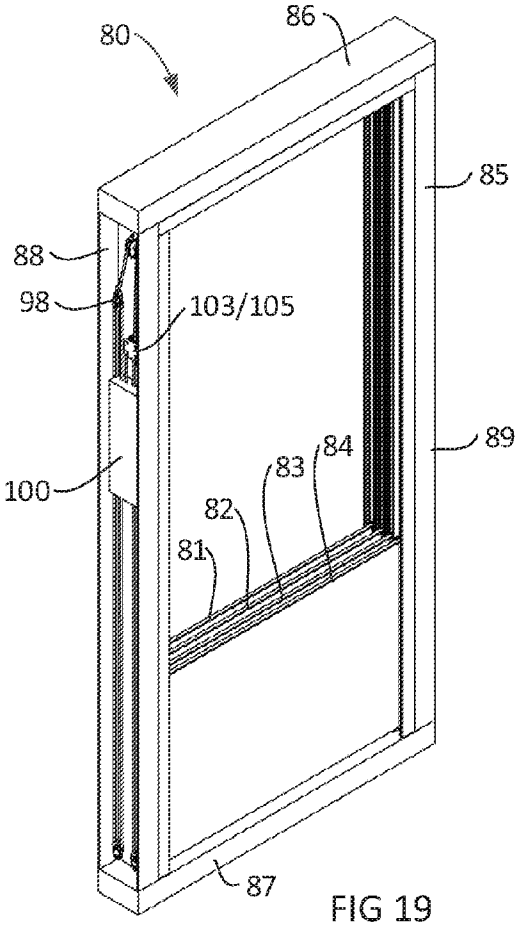
FIG. 19 is the same view as FIG. 17, except with the window panes shown in a substantially fully open position.
Figure 18:
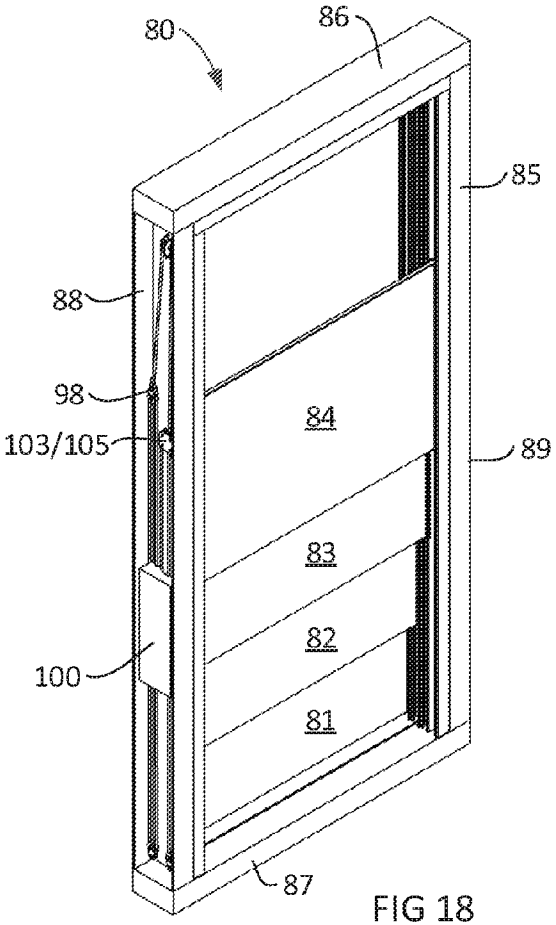
FIG. 18 is the same view as FIG. 17, except with the window panes shown in a partially open position.
Figure 17:
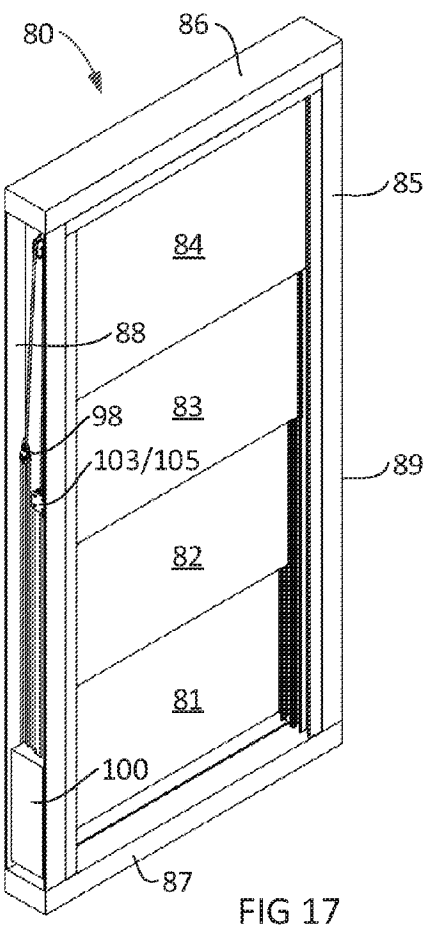
FIG. 17 is an isometric view of the window assembly of FIG. 16.

The sequence of movement is illustrated in FIGS. 17 to 19.

As with the earlier window assemblies 10 and 40, the window assembly 80 includes a frame 85 that comprises a head 86, a sill 87 and jambs 88 and 89. Side edges of the panes are accommodated in channels in the jambs 88 and 89, while upper and lower edges of the sliding pane 84 and the fixed pane 81 are also accommodated within channels formed in the head 86 and the sill 87 respectively, when the window assembly 80 is in the closed position of FIG. 16.

The window assembly 80 differs from the assemblies 10 and 40 described earlier herein, on the basis that it employs both floating pulleys and counterbalance weights for supporting the panes of the window assembly in the opened and closed positions and positions between the open and closed positions (see FIG. 18 for example).

Figure 20:
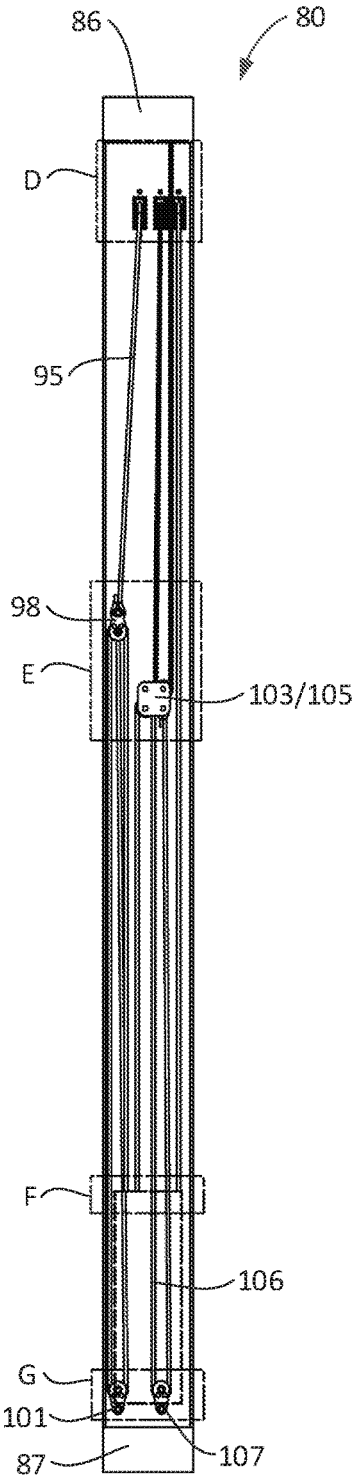
FIG. 20 is a side view of the window assembly of FIG. 16.

FIG. 20 is a side view of the window assembly 80 showing the arrangement applied to the side jamb 88, while FIGS. 21 to 24 show enlarged sections of the side view of FIG. 20 corresponding to sections D, E, F and G.

Figure 21:
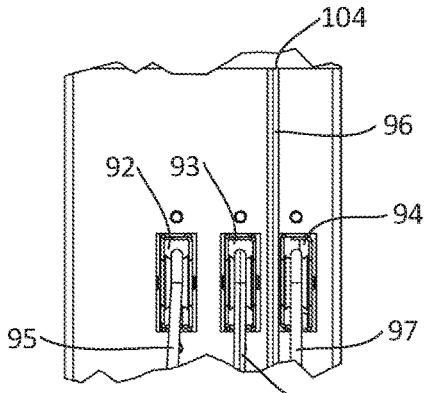
FIG. 21 is a detailed view of section D of FIG. 20.

With reference to FIGS. 20 and 21, three upper pulleys 92, 93 and 94 are provided, over which extend cords 95, 96 and 97. The cords 95, 96 and 97 extend into fixed connection with side edges of the panes 82, 83 and 84 respectively.

Figure 22:
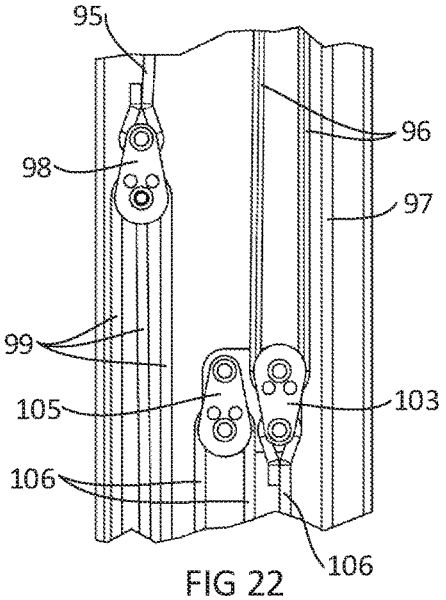
FIG. 22 is a detailed view of section E of FIG. 20.
Figure 23:
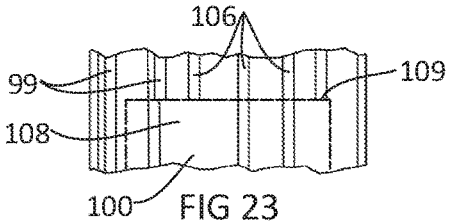
FIG. 23 is a detailed view of section F of FIG. 20.
Figure 24:
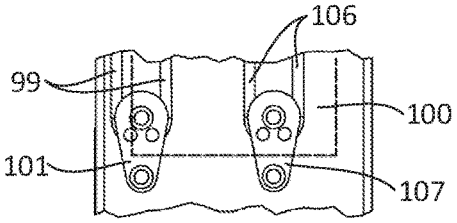
FIG. 24 is a detailed view of section G of FIG. 20.

The opposite end of the cord 95 extends into fixed connection with a floating pulley 98 (see FIG. 22). A further cord 99 is anchored at one end to a counterweight 100 (shown in broken outline in FIGS. 23 and 24), and extends upwardly and about the pulley 98. The cord 99 then extends downwardly about a fixed base pulley 101 and then upwardly into fixed connection with the pulley 98. Accordingly, as the pane 82 is lowered, the pulley 98 is lifted and through the gearing provided by the pulleys 98 and 101, the counterweight 100 also lifts.

The cord 96 extends over the pulley 93 downwardly about the pulley 103 and then then extends upwardly into fixed connection at the upper end of the jamb 88 at fixed anchor point 104. The pulley 103 is part of a floating double pulley, which also includes a further pulley 105.

A further cord 106 extends in fixed connection with the pulley 103 and extends downwardly about the base pulley 107 and upwardly about the pulley 105 and finally downwardly into fixed connection with the counterweight 100, at anchor point 108.

Finally, remaining cord 97 extends about the pulley 94 downwardly into fixed connection with the counterweight 100 at anchor point 109.

By the above arrangement, with reference to FIGS. 17 to 19, it can be seen that in the fully closed position of the window assembly 30, the weight 100 is at its lower most point in jamb 88. As the panes move downwardly as shown in FIG. 18, the weight 100 shifts upwardly, substantially the same distance as the pane 84 has moved. In FIG. 19, the weight 100 has moved again so that the extent of its total movement to bring the panes 82 to 84 to the fully opened position is approximately the same extent of movement as the pane 84.

Likewise, FIGS. 17 to 19 show movement of the floating pulley 98 and the double pulley 103/105 upwardly, with movement of the weight 100 upwardly. Clearly, movement of the panes towards the closed position as shown in FIG. 17, results in the reverse movement of the weight 100 and the pulleys 98 and 103/105.

Further, the arrangement shown in jamb 88 can be repeated identically in the jamb 89.

It would be evident from the above discussion and the description in relation to FIGS. 16 to 24, that arrangements according to the embodiments can include counterweights and pulleys, or just pulleys or just counterweights. Moreover, arrangements according to embodiments can include geared pulley arrangements and/or floating pulleys. The arrangements of the window assemblies 10 and 80 include only a single counterweight in one of the jambs illustrated, although in most embodiments, the arrangement of the illustrated jamb would be repeated on the opposite jamb as well. Advantageously, only a single counterweight is employed in a respective jamb, in contrast to prior art arrangements that require a counterweight for each pane. This is achieved by the use of geared and floating pulleys as described.

The embodiments of FIGS. 1 to 24 represent various examples of the present disclosure, but each example includes a fixed pane. The present disclosure can also extend to arrangements that include no fixed panes so that all of the panes can slide. Using the present drawings as examples, the present disclosure can provide an arrangement in which a pair of panes move between a window closed positon to a window open position and whereby in the window open position, the panes are received fully in or at least substantially within a pocket or recess and are thus obscured from view or are removed as an obstruction. Such a pocket or recess can be formed in a ceiling, floor or wall of a building in which the sliding window assembly is installed. With reference to FIGS. 2 to 4, the fixed pane 11 could be removed and the section of the frame 14 in which the pane 11 is accommodated could extend through an opening or into a pocket or recess in a ceiling or wall. Thus, the movable panes 12 and 13 could move from the window closed positon of FIGS. 2 to 4, to a window open position in which the panes 12 and 13 are accommodated within the pocket or recess.

Likewise, it will be recognised that movement of the panes 12 and 13 can be downwards rather than upwards (for example by rotating the window assembly 10 of FIGS. 2 to 4 through 180° and making suitable modifications to the counterbalance arrangement) so that the panes 12 and 13 could move downwards through an opening or into a pocket or recess formed in a wall or floor in the window open position.

In relation to FIGS. 17 to 19, a similar arrangement can be provided whereby the fixed pane 81 can be removed and the section of the frame 85 in which the pane 11 is accommodated could extend into an opening in the floor or into a pocket or recess.

Figure 27:
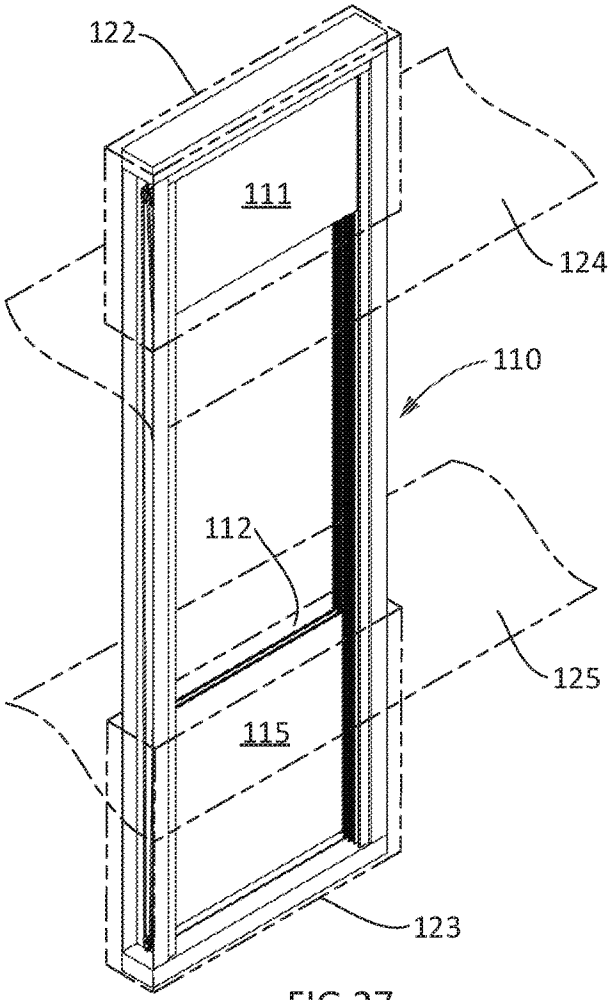
FIGS. 25 to 27 show a front view of a window assembly according to a further embodiment showing the sequence of pane movement between a window closed positon to a window open position.
Figure 26:
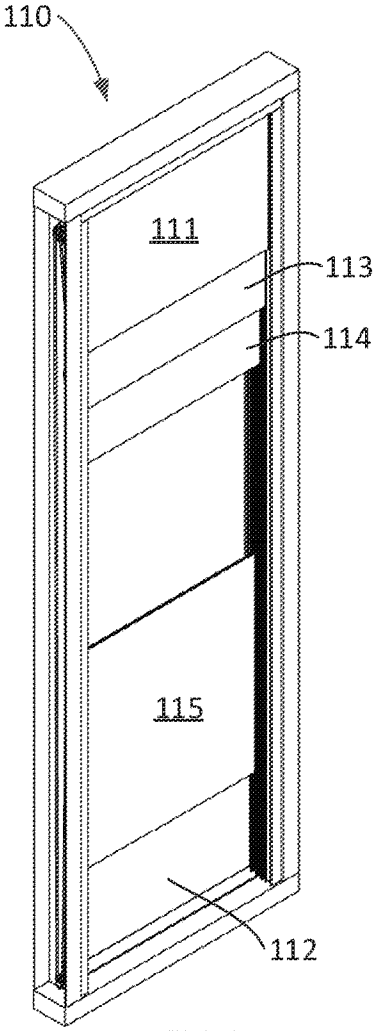
Figure 25:
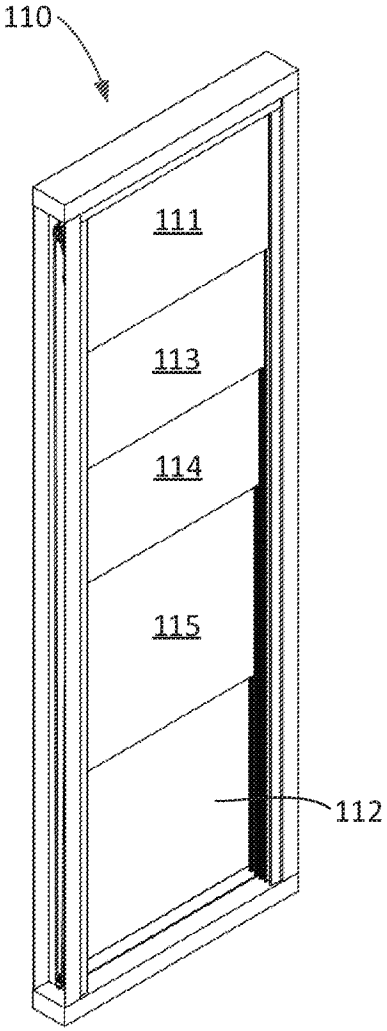

FIGS. 25 to 27 show a further arrangement in which a window assembly 110 according to the disclosure includes fixed bottom and top panes 111 and 112 and three sliding panes 113 to 115. It will be evident from the figures that panes 113 and 114 move upwardly from the window closed positon of FIG. 25 while pane 115 moves downwardly from that position. Importantly, it can easily be seen from FIGS. 25 to 27 that either or both of the fixed panes 111 or 112 could be removed and the section of the window assembly in which the panes 111 and/or 112 is/are accommodated could extend through an opening or into a pocket or recess in a ceiling or wall. With reference to FIG. 27, upper and lower pockets 122 and 123 are shown in phantom lines extending respectively upwardly from a ceiling 124 and downwardly from a floor 125.

Figure 28:
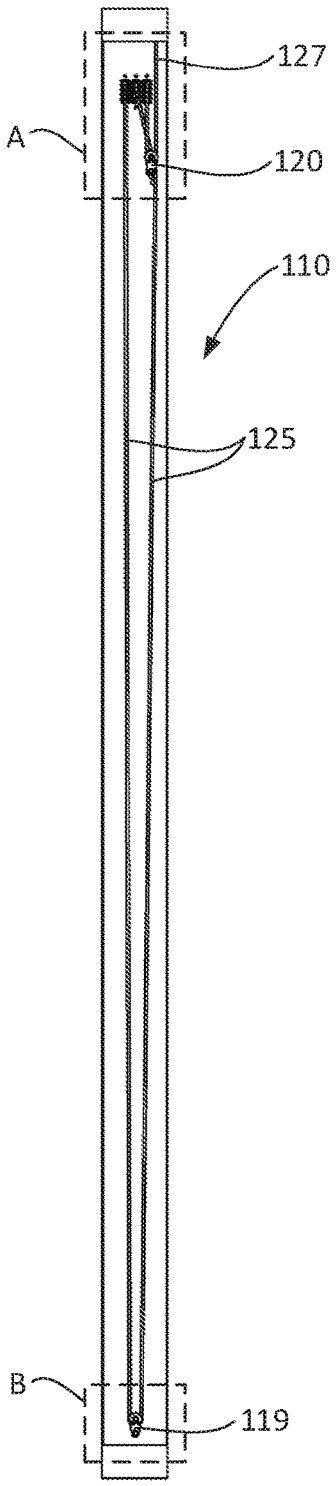
FIGS. 28 and 29 show side views of the window assembly of FIGS. 25 to 27 to illustrate the counterbalance arrangement.
Figure 29:
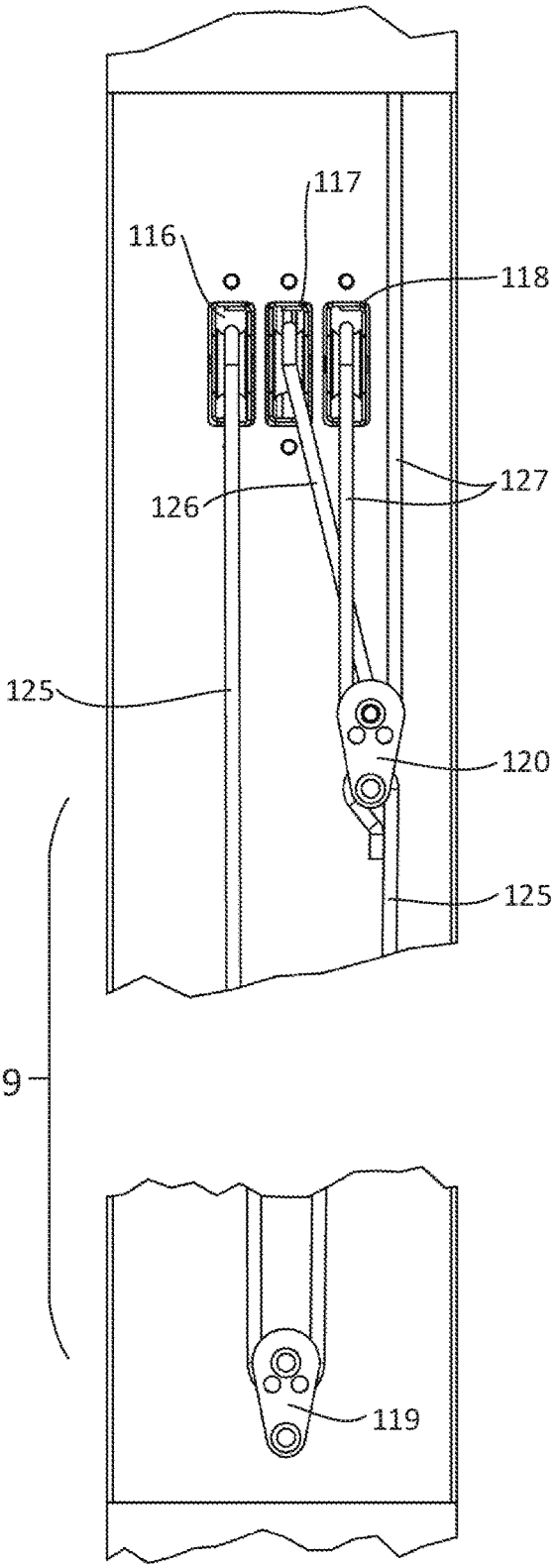

The arrangement of FIGS. 25 to 27 can operate without a separate counterbalance as shown in FIGS. 28 and 29 which are side views of the window assembly 110. From FIGS. 28 and 29, it can be seen that the pulley arrangement comprises three upper pulleys 116 to 118 and a lower pulley 119. A floating pulley 120 is positioned intermediate the upper and lower pulleys.

Cord 125 extends about pulley 116 and into connection with pane 115. Cord 125 also extends downwardly and about pulley 119 before extending upwardly into connection with floating pulley 120.

Cord 126 extends about pulley 117 into connection with pane 113 and also into connection with floating pulley 120.

Cord 127 extends about pulley 118 into connection with pane 114 and also about floating pulley 120. Cord 127 then extends upwardly to an anchor point in the frame of the window assembly 110.

The arrangement of window assembly 110 allows the pane 114 to move upwardly twice the distance that the pane 113 moves from the window closed positon to the window open position. The arrangement also allows the pane 115 to move the same distance as the pane 114, but in a downward direction.

The embodiments described herein are susceptible to variations, modifications and/or additions other than those specifically described and it is to be understood that the embodiments include all such variations, modifications and/or additions which fall within the spirit and scope of the present disclosure.

Throughout the description and claims of the specification, the word "comprise" and variations of the word, such as "comprising" and "comprises", is not intended to exclude other additives, components, integers or steps. The scope of the present disclosure should, therefore, be determined only by the following claims.

The invention claimed is:

1. A sliding window assembly, including:

a window frame comprising a pair of spaced apart horizontal frame members and a pair of spaced apart vertical frame members, the frame members defining a square or rectangular window opening;

at least three panes disposed within the window frame comprising first and second sliding panes and a third fixed pane;

the panes being positioned within the frame in offset vertical planes;

the first and second panes being arranged for sliding movement together upwardly within the window frame or together downwardly within the window frame, the first and second panes having a combined weight;

the panes having a fully open position and a fully closed position, whereby in the fully closed position, a first edge of the first pane is in overlap with an adjacent first edge of the second pane and a second edge of the second pane that is opposite to the first edge of the second pane is in overlap with an adjacent first edge of the third pane;

in the fully open position, the first and second panes overlap with the third pane;

the first and second panes being connected to a counterweight arrangement by a pulley arrangement, the counterweight arrangement providing a vertically movable balancing weight which is associated with one of the vertical frame members, and the counterweight arrangement supports the combined weight of the first and second panes;

the first pane being connected to the balancing weight by a cord in connection with the first pane that extends upwardly about a first pulley and downwardly into fixed connection with the balancing weight; and the second pane being connected to the balancing weight by a cord arrangement that includes:

a first cord in connection with the second pane that extends upwardly about a second pulley and downwardly into fixed connection with a third pulley; and a second cord in fixed connection with the balancing weight that extends upwardly about the third pulley and downwardly to an anchor point.

2. A sliding window assembly according to claim 1, the first and second panes both being on one side of the third pane in the fully open position.

3. A sliding window assembly according to claim 1, the first and second panes being on opposite sides of the third pane in the fully open position.

4. A sliding window assembly according to claim 1, the first pane having a second edge opposite the first edge of the first pane, and the first and second panes each being in complete overlap with the third pane in the fully open position such that the edge of the third pane.

5. A sliding window assembly according to claim 1, wherein:

the first and second panes are slidable together upwardly to the fully open position;

the first pane has a second edge opposite the first edge of the first pane; and the first and second panes having a staggered overlap with the third pane when in the fully open position, so that the second edge of the first pane is spaced below the first edges of the second and third panes, and the first edge of the second pane is spaced below the first edge of the third pane.

6. A sliding window assembly according to claim 5, a finger grip being applied to the first edge of the first pane for initiating vertical movement of the first and second panes.

7. A sliding window assembly according to claim 1, the first pane moving approximately twice the distance of the second pane to reach the fully open position of the window assembly from the fully closed position.

8. A sliding window assembly according to claim 1, including four panes disposed within the window frame comprising first and second sliding panes and third and fourth fixed panes, the panes being positioned within the frame in offset vertical planes, the first and second panes being arranged for sliding movement together upwardly within the window frame or together downwardly within the window frame.

9. A sliding window assembly according to claim 8, the third and fourth fixed panes being positioned within respective upper and lower sections of the window frame and the first and second panes being slidable to the open position in overlap with one of the third and fourth fixed panes.

10. A sliding window assembly according to claim 1, the first and second pulleys being supported in one of the vertical frame members.

11. A sliding window assembly according to claim 1, the vertical frame members being formed to have respective outwardly opening channels and the balancing weight being accommodated at least partially within the outwardly opening channel of one of the vertical frame members.

12. A sliding window assembly according to claim 1, the counterweight arrangement and the pulley arrangement being provided in association with one of the vertical frame members of the window frame.

13. A sliding window assembly according to claim 1, the vertically movable balancing weight of the counterweight arrangement including first and second vertically movable balancing weights, and the pulley arrangement includes, a first pulley arrangement supported by one of the vertical frame members of the window frame and connected to the first moveable balancing weight, and a second pulley arrangement supported by the other of the vertical frame members of the window frame and connected to the second movable balancing weight.

14. A sliding window assembly comprising:

a window frame including a pair of spaced apart horizontal frame members and spaced apart first and second vertical frame members, the frame members defining a square or rectangular window opening;

at least three panes disposed within the window frame including first and second sliding panes and a fixed third pane, the panes being positioned within the frame in offset vertical planes, the first and second panes being arranged for sliding movement together upwardly within the window frame or together downwardly within the window frame, the first and second panes having a combined weight;

the panes having a fully open position and a fully closed position, whereby in the fully closed position, a first edge of the first pane is in overlap with an adjacent first edge of the second pane and a second edge of the second pane that is opposite to the first edge of the second pane is in overlap with an adjacent first edge of the third pane;

in the fully open position, the first and second panes overlap with the third pane;

the first and second panes being connected to a counterweight arrangement by a pulley arrangement, the counterweight arrangement including a first vertically movable balancing weight which is associated with the first vertical frame member, and a second vertically movable balancing weight which is associated with the second vertical frame member, and the first and second balancing weights have an aggregate weight that is greater than a weight of the first pane and less than the combined weight of the first and second panes;

the first pane being connected to the first balancing weight by a first cord in connection with a first side edge of the first pane, the first cord extending upwardly about a first pulley and downwardly into fixed connection with the first balancing weight;

the second pane being connected to the first balancing weight by a first arrangement that includes:

a second cord in connection with a first side edge of t the second pane, the second cord extending upwardly about a second pulley and downwardly into fixed connection with a third pulley, and a third cord in fixed connection with the balancing weight, the third cord extending upwardly about the third pulley and downwardly to a first anchor point, the first pane being connected to the second balancing weight by a fourth cord in connection with a second side edge of the first pane opposite the first side edge of the first pane, the fourth cord extending upwardly about a fourth pulley and downwardly into fixed connection with the second balancing weight; and the second pane being connected to the second balancing weight by a second arrangement that includes:

a fifth cord in connection with a second side edge of the second pane opposite the first side edge of the second pane, the fifth cord extending upwardly about a fifth pulley and downwardly into fixed connection with a sixth pulley, and a sixth cord in fixed connection with the second balancing weight, the sixth cord extending upwardly about the sixth pulley and downwardly to a second anchor point.

15. A sliding window assembly according to claim 1, the first and second panes being of substantially the same perimeter dimensions.

16. A sliding window assembly according to claim 1, whereby the first and second panes are movable upwardly or downwardly through an opening or into a recess or pocket.

17. A sliding window assembly according to claim 16, the opening, recess or pocket being formed in a wall, ceiling or floor.

18. A sliding window assembly, including:

a window frame comprising a pair of spaced apart horizontal frame members and a pair of spaced apart vertical frame members, the frame members defining a square or rectangular window opening;

first and second sliding panes disposed within the window frame and being positioned within the frame in offset vertical planes;

the first and second panes being arranged for sliding movement together upwardly within the window frame or together downwardly within the window frame, the first and second panes having a combined weight;

the first and second panes being connected to a counterweight arrangement by a pulley arrangement, the counterweight arrangement providing a vertically movable balancing weight, and the counterweight arrangement supports the combined weight of the first and second panes;

the first pane being connected to the balancing weight by a cord in connection with the first pane that extends upwardly about a first pulley and downwardly into fixed connection with the balancing weight; and the second pane being connected to the balancing weight by a cord arrangement that includes:

a first cord in connection with the second pane that extends upwardly about a second pulley and downwardly into fixed connection with a third pulley; and a second cord in fixed connection with the balancing weight that extends upwardly about the third pulley and downwardly to an anchor point, whereby the first and second panes are movable upwardly or downwardly at least substantially through an opening or into a recess or pocket.

19. A sliding window assembly according to claim 18, the opening, recess or pocket being formed in a wall, ceiling or floor.

20. A sliding window assembly according to claim 18, a finger grip being applied to an edge of the first or second pane for initiating vertical movement of the first and second panes.

21. A sliding window assembly according to claim 18, the first pane moving approximately twice the distance of the second pane between open and closed positions of the window assembly.

22. A sliding window assembly according to claim 18, the first and second pulleys being supported in one of the vertical frame members.

23. A sliding window assembly according to claim 18, the vertical frame members being formed to have respective outwardly opening channels and the balancing weight being accommodated at least partially within the outwardly opening channel of one of the vertical frame members.

* * * * *